United States Patent [19]

Endo et al.

[11] Patent Number: 4,496,402

[45] Date of Patent: Jan. 29, 1985

[54] FE-CR-CO TYPE MAGNET BODY OF COLUMNAR STRUCTURE AND METHOD FOR THE PREPARATION OF SAME

[75] Inventors: Masaji Endo; Takami Hikone, both of Osaka, Japan

[73] Assignee: Sumitomo Special Metals Co., Ltd., Osaka, Japan

[21] Appl. No.: 356,262

[22] Filed: Mar. 9, 1982

[30] Foreign Application Priority Data

Mar. 10, 1981 [JP] Japan ..... 56-34795

[51] Int. Cl.[3] ..... H01F 1/04

[52] U.S. Cl. ..... 148/31.57; 148/404; 148/442; 420/583

[58] Field of Search ..... 148/31.55, 31.57, 404, 148/419, 442; 420/583; 75/126 H; 428/611

[56] References Cited

U.S. PATENT DOCUMENTS

| | | | |
|---|---|---|---|
| 4,075,437 | 2/1978 | Chin et al. | 148/31.57 |
| 4,171,978 | 10/1979 | Inoue | 148/31.57 |
| 4,236,919 | 12/1980 | Kamino | 148/31.57 |
| 4,246,049 | 1/1981 | Bronner et al. | 148/31.57 |
| 4,251,293 | 2/1981 | Jin | 148/31.57 |
| 4,253,883 | 3/1981 | Jin | 148/31.57 |
| 4,263,044 | 4/1981 | Inoue | 75/126 H |
| 4,311,537 | 1/1982 | Chin et al. | 148/31.57 |
| 4,324,597 | 4/1982 | Kamino et al. | 148/31.57 |

FOREIGN PATENT DOCUMENTS

| | | | |
|---|---|---|---|
| 5612300 | 4/1978 | Japan . | |
| 54-33205 | 3/1979 | Japan . | |
| 55-41987 | 3/1980 | Japan . | |
| 56-254 | 6/1981 | Japan | 148/31.57 |
| 7905311 | 1/1980 | Netherlands . | |
| WO81/00643 | 3/1981 | PCT Int'l Appl. | 148/31.57 |

OTHER PUBLICATIONS

Reed-Hill, *Physical Metallurgy Principles Second Edition*, 1973, pp. 588 to 593.

McGannon, *The Making, Shaping and Treating of Steel*, 8th ed., 1964, p. 550.

J. Appl. Phys., vol. 52, No. 3, Mar. 1981, Chin et al., "Low Cobalt Cr-Co-Fe Permanent Magnet Alloys", pp. 2536-2541.

Cobalt, vol. 43, Jun. 1969, Palmer et al., "Production of Columnar Castings in High-Coercivity Magnet Alloys Containing 5-10% Titanium, pp. 64-72.

Cobalt, vol. 54, Mar. 1972, Fontaine et al., "Reaction Mechanisms in the 'Magnicol' Process for Producing Columnar Structures in Fe-Al-Ni-Co-Ti Permanent Magnet Alloys", pp. 18-26.

IEEE Transactions on Magnetics, vol. MAG-16, No. 3, May, 1980, Minowa et al., "Further Studies of the Miscibility Gap in an Fe-Cr-Co Permanent Magnet System", pp. 529-533.

AIP Conf. Proc., No. 29, 1975, Kaneko et al., "Fe--Cr-Co Ductile Magnet with (BH) max—8 MGOe", pp. 620-621.

IEEE Transactions on Magnetics, vol. MAG-16, No. 5, Sep. 1980, Jin et al., "Deformation Aged Cr-Co-Cu-Fe Permanent Magnet Alloys", pp. 1050-1052.

*Primary Examiner*—John P. Sheehan

*Attorney, Agent, or Firm*—Burns, Doane, Swecker and Mathis

[57] ABSTRACT

An Fe-Cr-Co type magnet body of columnar structure having a maximum energy product $(BH)_{max}$ of 7 MGOe or higher consisting essentially of, by weight ratio, 5-30% cobalt, 15-40% chromium, 0.1-10% molybdenum, 0.05-1.2% titanium and 0.1-5% vanadium, with the balance being iron and inevitable impurities, said body having been subjected to columnar-crystallization.

7 Claims, 17 Drawing Figures

FE-CR-CO TYPE MAGNET BODY OF COLUMNAR STRUCTURE AND METHOD FOR THE PREPARATION OF SAME

FIELD OF THE INVENTION

The present invention relates generally to a Fe-Cr-Co type magnet body, and more particularly to a Ti-containing Fe-Cr-Co magnet body of columnar structure that can easily be obtained by columnar-crystallization.

BACKGROUND OF THE INVENTION

The Fe-Cr-Co type magnet alloy is a Spinodal type alloy discovered in 1971 for the first time, which is known as a ductile magnet alloy. This alloy is rich in tenacity and capable of being processed by rolling, wire drawing, blanking and deep drawing in its solution heat-treated state.

This magnet alloy had originally a Co content of 17–23% by weight and showed magnetic characteristics only comparable with those of ALNICO 5. As a result of later research on alloying elements or components and heat treatment, however, a composition system comprising a reduced amount of Co ranging 5–15% by weight has been proposed and put to practical use, which exhibits magnetic characteristics equivalent to or better than those of ALNICO 5 or ALNICO 5DG. It is also known that the addition of minor amounts of Mo, W, Si, etc. enhances the magnetic characteristics and coercive force of such an alloy system.

Where the Fe-Cr-Co type magnet alloy is melted in the atmosphere and cast, if atmospheric nitrogen (N) enters the molten metals in the meantime, crystallization of a gamma phase takes place, leading to deterioration in magnetic characteristics. To prevent the crystallization of the gamma phase having a markedly adverse influence on magnetic characteristics, the addition of titanium (Ti) was found to be very effective. Usually titanium is added in an amount of about 1% by weight during melting. Fe-Cr-Co type magnet alloys having a low cobalt content, which are recently on the market, are manufactured on an industrial scale by melting in the atmosphere, taking advantage of the effect of Ti addition.

SUMMARY OF THE DISCLOSURE

It has been found, however, that difficulties are encountered in the columnar-crystallization of Ti-containing Fe-Cr-Co type magnet alloys. It is therefore a main object of this invention to provide an improved Fe-Cr-Co type magnet body of columnar structure in the Fe-Cr-Co type magnet alloys.

This invention provides an Fe-Cr-Co type magnet body essentially consisting of, by weight ratio, 5–30% cobalt, 15–40% chromium, 0.1–10% molybdenum, 0.05–1.2% titanium and 0.1–5% vanadium, with the balance being iron and inevitable impurities, said body being subjected to columnar crystal growth or columnar-crystallization.

Findings underlying the present invention are that the addition of titanium has a detrimental influence on the growth of columnar structure for all the well-known effect, and that such an adverse influence of titanium on the growth of columnar structure is eliminated or suppressed by adding vanadium.

The magnet body according to this invention has a maximum energy product $(BH)_{max}$ of 7 MGOe or higher and 8 or higher in a preferred embodiment. Such high magnetic characteristics have been attained by adding vanadium to an Fe-Cr-Co-Mo-Ti base component to give rise to its columnar-crystallization. The range of the composition (V-Ti) encircled with a closed curve obtained by connecting points A, B, C, D, E, F, G, H, I, and A in the graphic diagram of FIG. 8 shows particularly preferable magnetic characteristics ($(BH)_{max} \geqq 7$ MGOe).

BRIEF DESCRIPTION OF THE DRAWINGS

FIGS. 2*a*–2*d* are photographs of macro-structures showing that Ti is an element detrimental to the growth of columnar structure, wherein FIGS. 2*a*–2*d* illustrate the alloys of samples 1–4 in Table 1, respectively;

FIGS. 3*a*–3*d* are photographs of macro-structures showing the relationship between the addition of Ti and the growth of columnar structure, wherein FIGS. 3*a*–3*d* show the alloys of samples 5–8 in Table 2, respectively;

These figures are given for the convenience of illustration of this invention, and not intended to place limitations thereto.

DETAILED DESCRIPTION OF THE INVENTION

Reference will now be made to the upper and lower limits of the components used in this invention.

Cobalt constitutes a main component with iron and chromium. If the cobalt content is less than 5% , longer periodes of time are required for isothermal magnetic treatment; if it exceeds 30%, the desired machinability cannot be attained. This is the reason why the cobalt content is restricted to a range of 5–30%.

The chromium content is limited to a range of 15–40%, because no deposition of an $alpha_1$ phase in an $alpha_2$ phase occurs in an amount less than 15%, whereas a chromium quantity exceeding 40% is detrimental to workability.

Molybdenum is an element contributing to a higher coercive force and, like ALNICO5 and 8, causes preferential orientation of alpha$_1$ particles in the direction of (100). Molybdenum, if used in amounts less than 0.1%, becomes ineffective; and if applied in an amount more than 10%, makes no further contribution to improvement in coercive force. Thus, the molybdenum content is limited to a range of 0.1–10%.

Titanium in an amount of up to 1.2% is effective for preventing crystallization of a gamma phase, thus the deterioration in magnetic characteristics. A greater amount than 1.2% of Ti suppresses columnar-crystallization to an extreme extent and is thus undesirable. The effect of Ti-addition is observed in a residual amount of 0.05% or more. Preferably, titanium is comprised in an amount of 0.1–0.6%, more particularly 0.2–0.4%.

The wording "inevitable impurities" here refers to ingredients which are inevitably entrained in starting materials in the course of production, and have no outstanding influence on magnetic characteristics. The impurities include not exceeding 0.5% Si, not exceeding 0.1% Ni, not exceeding 0.1% Al, not exceeding 0.1% Mn, etc., and in total not exceeding 1%, normally.

Vanadium is effective for depressing the detrimental influence of titanium added on the columnar-crystallization. In an amount exceeding 5%, however, it causes drop in residual magnetic flux density. The effect of V addition is observed in an amount of 0.1% or more. The vanadium content is preferably in a range of 0.2–4%, more particularly 0.3–3%. In what follows, this invention will now be elucidated with reference to the experimental data and the non-restrictive examples.

As stated previously, titanium is a considerably effective denitrification agent for the fixation of atmospheric nitrogen; however, it is detrimental to the columnar-crystallization of Fe-Cr-Co type magnet alloys, as will be exhibited below on the basis of test results.

TEST 1

Figure 1:
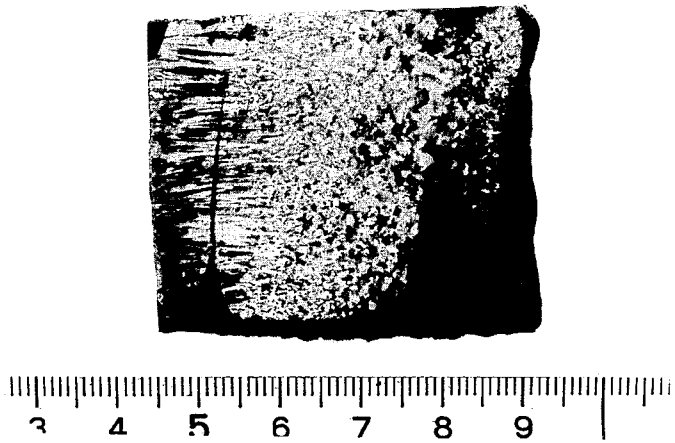
FIG. 1 is a photograph illustrative of the macro-structure of a V-free Fe-Cr-Co magnet alloy.
Figure 2A:
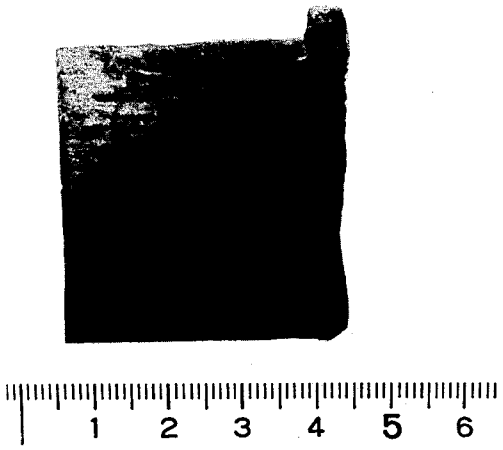
Figure 2B:
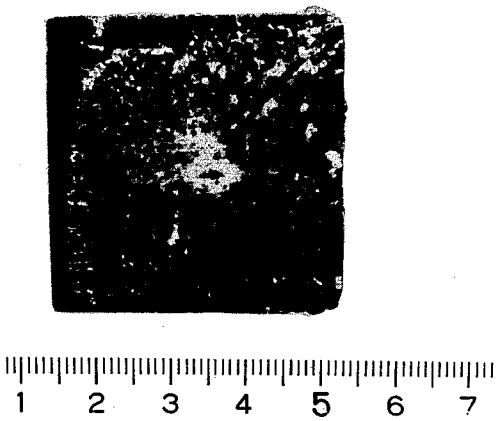
Figure 2C:
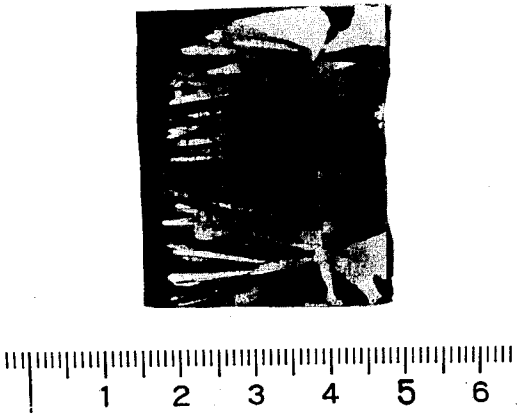
Figure 2D:
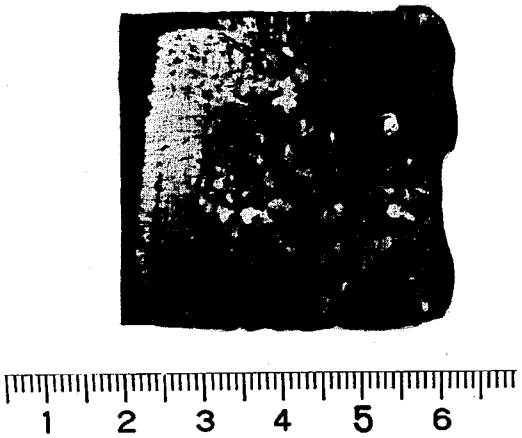
Figure 3A:
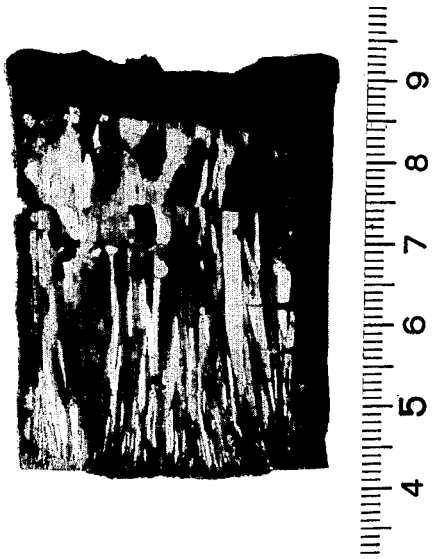
Figure 3B:
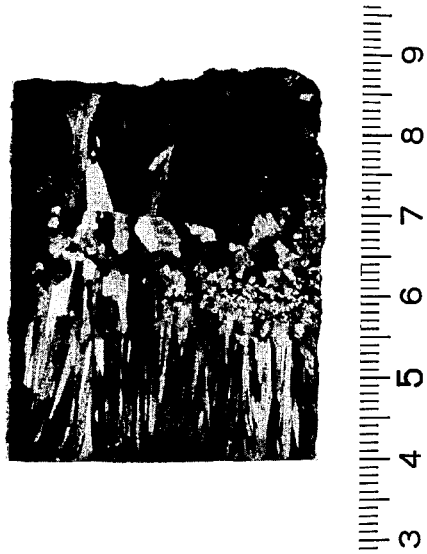
Figure 3C:
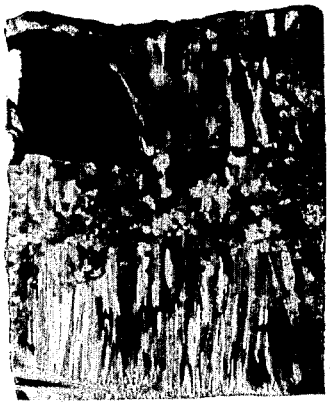
Figure 3D:
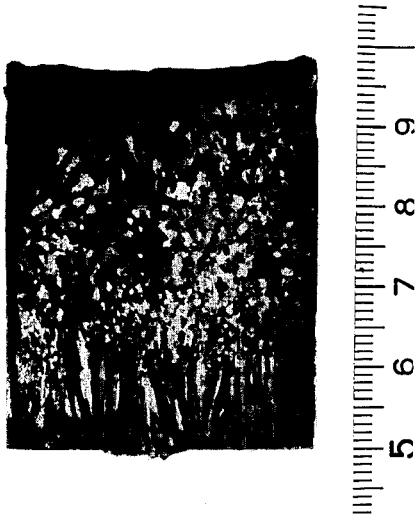

By melting a material composition of, by weight ratio, 24% Cr—15% Co—3% Mo—1.0% Ti—the balance Fe was prepared using electrolytic iron, electrolytic cobalt, metallic chromium, metallic molybdenum and spongy titanium as the starting Fe, Cr, Co, Mo and Ti which are the same starting materials as employed in Example 1. The resultant melt was cast in a $40^{\phi}\times47^{l}$ mm exothermic mold in which a $100^{\phi}\times15^{t}$ mm chill plate was used. The macro-structure of the thus cast mass is shown in FIG. 1, indicating that the columnar structure having a height of only about 10 mm was obtained normal to the chill plate. With a view to seeking out the cause for which the growth of columnar structure is hampered, samples whose material compositions are shown in Table 1 were cast in a $40^{\phi}\times30^{l}$ mm shell mold on its bottom provided with a $100^{\phi}\times15^{t}$ mm chill plate.

TABLE 1

| Samples | Compositions (% by weight) |
|---|---|
| 1 | 24 Cr—15 Co—balance Fe |
| 2 | 24 Cr—15 Co—1.5 Ti—balance Fe |
| 3 | 24 Cr—15 Co—3 Mo—balance Fe |
| 4 | 24 Cr—15 Co—3 Mo—1.5 Ti—balance Fe |

FIGS. 2*a*–2*d* show the macro-structures of test pieces cut out of each sample, and reveals that samples 1 and 3 are well columinarly-crystallized due to the DG (directional growth) effect of the chill plate. On the other hand, it is found that samples 2 and 4 containing titanium is columinarly-crystallized to only a very small extent in comparison to titanium-free samples 1 and 3. Samples 2 and 4 have not appreciably columnarly grown even though the DG treatment by the chill plate has been effected.

From these results, it turns out that the inclusion of titanium is ascribable to the inhibition of trans-crystallization of such alloys as exemplified by Samples 2 and 4. Probably, the reasons are that titanium is bonded to nitrogen to yield a TiN compound which is then converted into a crystal nuclear in front of the solid solution boundary. Samples 1 and 3 undergo columnar-crystallization with no difficulty, but they do not possess satisfactory magnetic characteristics since nitrogen invades them during melting owing to the absence of titanium.

TEST 2

The results of Test 1 account for the detrimental influence of elemental titanium on columnar-crystallization. To clarify this further, the relationship between the amount of titanium and the columnar-crystallization was closely examined with the procedures in which, like Test 1, casting was effected in a shell mold. More specifically, a material composition of, by weight ratio, 24% Cr—15% Co—3% Mo—the balance Fe was cast in the atmosphere with the addition of varying amounts of titanium. Amounts of titanium in the resultant alloy samples were analyzed and shown in Table 2.

TABLE 2

| Samples | Ti (% by weight) added | Ti (% by weight) analysis |
|---|---|---|
| 5 | 0.2 | 0.10 |
| 6 | 0.4 | 0.16 |
| 7 | 0.6 | 0.24 |
| 8 | 0.8 | 0.32 |

The macro-structure of a test piece taken out of each sample is shown in FIGS. 3*a*–3*d*. The results indicate that sample 5 containing the least amount of titanium has its columnar structure grown to the largest degree, whereas sample 8 containing the largest amount of titanium has its columnar structure grown to the least extent. It follows that the degree of the columnar-crystallization drops proportional to the amount of titanium.

TEST 3

Further experiments reveal that considerable difficulties are still encountered in the industrial realization of columnar-crystallization of the alloys of the foregoing type with recourse to the addition of titanium alone. A material composition of, by weight ratio, 24% Cr—15% Co—3% Mo—1% Ti—the balance Fe was melted in the atmosphere, and cast in an exothermic mold into a magnet body of 45×25×44 mm in size. Various materials for exothermic molds were examined at varying catch fire rates and in varying amounts of heat generated, but no satisfactory results were obtained. This means that the detrimental effect of titanium cannot be avoided by thermal conditions.

Figure 4:
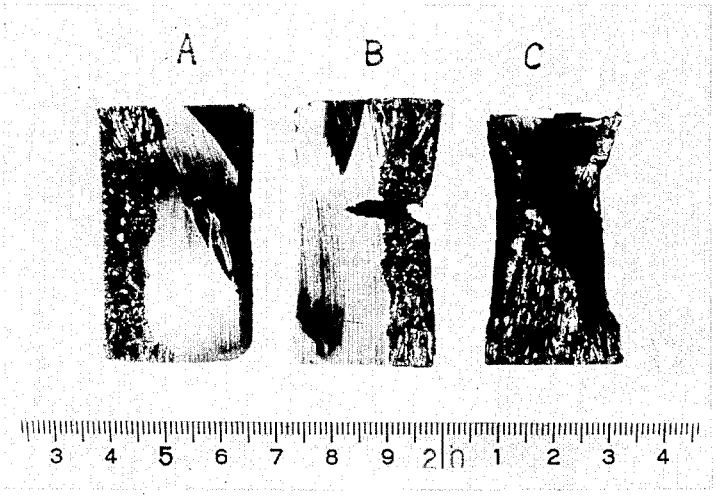
FIG. 4 is a photograph showing the macro-structure of a Cr-Co-Mo-Ti-Fe alloy cast in an exothermic mold, and illustrating the relationship between the amount of heat to be generated, the casting characteristics and the growth of columnar structure, casting being effected with the amount of heat which increases incrementally in the order of A, B and C.

One example of the test results is illustrated in terms of macro-structure in FIG. 4. The amount of heat to be generated was then increased incrementally in the order of A, B and C. Columnar-crystallization was only observed in case of C where the amount of heat to be generated from an exothermic material was increased, and the catch fire time was virtually instantaneous. In Experiment C, however, no casting of practically satisfactory shape was obtained, since the exothermic mold material is designed unsatisfactorily from the standpoint of gas evolution, so that the casting may suffer draw or shrinkage cavities because of gases evolved from the exothermic mold material. In Experiment A, on the contrary, the exothermic mold material was designed to reduce the amount of heat to be generated to a lower level to fabricate a casting of satisfactory shape. However, it is evident from the photograph that columnar-crystallization does not virtually occur. From Experiment B which was conducted to present one in-between example between A and C, it is also evident that the resultant casting is much apart from an Fe-Cr-Co magnet alloy of the columnar structure.

The foregoing arrives at the conclusion that improvements should be introduced in the columnar-crystallization of Fe-Cr-Co magnet alloys by mitigating the detrimental effect of titanium and avoiding deteriorations in magnetic characteristics.

As consequence of investigation made on the elements to be added for this purpose, it has now been found that the addition of vanadium mitigates the detrimental effect of titanium so that the columnar-crystallization is facilitated and promoted, and has no adverse influence on magnetic characteristics.

This invention has been accomplished on the basis of such findings.

Generally, an alloy body is made by casting a melt of the specific alloy composition, melting being effected at about 1700° C. It is noted that the alloy having the composition according to this invention can sufficiently be columnarly-crystallized in general suitable methods known for the columnar-crystallization of alloys, inclusive of zone-melting and casting in heating or exothermic molds provided with chill plates.

According to a preferred embodiment, casting is usually done in a heating mold heated at 1100°-1200° C.

The resultant cast alloy body is subjected to further treatments including solution heat-treatment, thermomagnetic treatment and aging. Solution heat-treatment is carried out at 1100°-1300° C. for approximately 10-30 minutes followed by heat treatment including thermomagnetic treatment including isothermal magnetic treatment (635°-650° C., for about 10 minutes, $H \geqq 2.0$ KOe). Finally, stepped or multistage aging is conducted at 600°-500° C. to obtain a magnet body. It should be understood that the solution heat-treatment is usually followed by rapid quenching (water quenching, etc.) or slow quenching. Preferably, the heat treatment including the isothermal magnetic treatment involves pre-heat treatment (680°-780° C., for around 10 minutes) and post-heat treatment (615°-630° C., for about 30 min.), and these three treatments are conducted in a stepped manner. The aging is preferably effected from the high-temperature side in a multistage manner.

Figure 9:
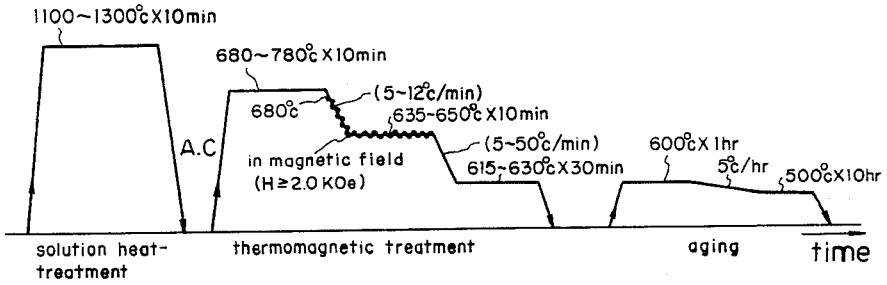
FIG. 9 is illustrative of a process for solution heat-treatment, heat treatment in a magnetic field including an isothermal magnetic treatment, and stepped aging treatment according to this invention, wherein a wavy line represents application of a magnetic field.

The process including the solution heat-treatment, isothermal magnetic treatment and aging treatment is illustrated in FIG. 9. As shown in FIG. 9, the thermomagnetic treatment is in detail preceded by a cooling stage (preferably at a rate of 5°-15° C./min) in a magnetic field, following to the pre-heat treatment of 680°-780° C., which cooling in a magnetic field is effected starting from 680° C. until reaching the subsequent isothermal magnetic treatment. After the isothermal magnetic treatment, the alloy is allowed to cool at a rate preferably of 5°-50° C./min then to reach the post-heat treatment, followed by quenching.

The aging is preferably made as follows: starting from heating at 600° C. for about one hour, allowed to gradually cool, preferably at an rate of 5° C./hr to a subsequent level of 500° C., thereat kept for about 10 hours, then finally cooled.

EXAMPLE 1

For the purpose of comparison, an alloy having a composition of, by weight ratio, 24% Cr—15% Co—3% Mo—0.4% Ti—the balance being essentially Fe was melted at 1700° C. in the atmosphere by application of high frequency. The melt is cast in an exothermic mold designed to yield a casting of $40^{\phi} \times 47$ mm size and in a shell mold designed to yield a casting of $40^{\phi} \times 35$ mm size, each mold being provided with a $100^{\phi} \times 15^{t}$ mm iron plate serving as a chill plate. Starting materials are the same as recited in Test 1 having purities by weight % of 99.3% Cr, 99.9% Co, 99.7% Mo, 99.5% Ti and 99.9% Fe.

In the same manner as mentioned above, on the other hand, the inventive alloy having the composition of, by weight ratio, 24% Cr—15% Co—3% Mo—0.4% Ti—0.3% V—the balance being essentially Fe was cast in a shell mold equipped with a chill plate and was compared to a sample of $5^{\phi} \times 10$ mm size with free crystal structure.

Figure 5:
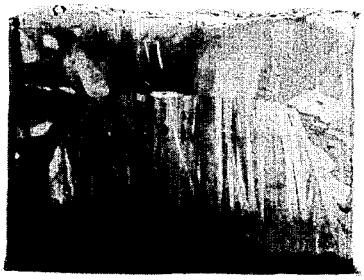
FIG. 5 is a photograph of the macro-structure of a 0.3% V-containing alloy prepared according to the present invention.

As a result that each of the cast alloys was examined on the growth of the columnar structure, the vandadium-free alloys, viz. the control alloys, had no sign of the satisfactory growth of the columnar structure in either casting process. As will be appreciated from the macrostructure illustrated in FIG. 5, however, the alloy according to this invention has a well grown columnar structure normal to the chill plate.

Samples of the free structure and columnar structure each cut out of the cast alloy were solution heat-treated at 1250° C. for 20 min followed by water quenching. Subsequently, the resultant masses were heat-treated by the process as shown in FIG. 9, in a magnetic field, i.e., heated to 700° C. for 10 min, cooled at 5° C./min in a magnetic field of $H=2.4$ KOe from 680° C. to 650° C., thereat kept for 10 min, cooled at 20° C./min to 630° C., thereat kept for 30 min, then cooled. Stepped aging followed which comprised one-hour heating at 600° C., cooling effected at a cooling rate of 5° C./hour, ten-hour heating at 500° C., and final cooling. The magnetic characteristics of the magnet bodies are summarized in Table 3 for the purpose of comparison.

TABLE 3

| Magnetic Characteristics | Free Structure | Columnar Structure |
|---|---|---|
| Br (KG) | 13.4 | 14.1 |
| He (Oe) | 735 | 860 |
| $(BH)_{max}$(MGOe) | 5.7 | 8.2 |

EXAMPLE 2

Figure 6A:
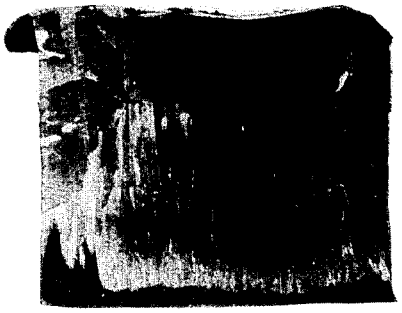
FIGS. 6*a* and 6*b* are photographs of macro-structures of the inventive alloys containing 0.3% V and 2.0% V, respectively.
Figure 6B:
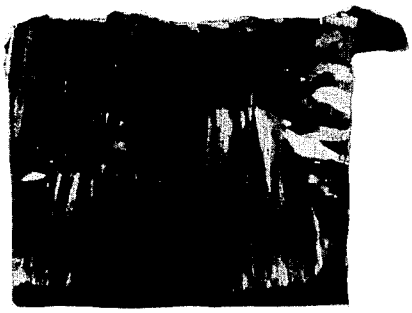
Figure 7A:
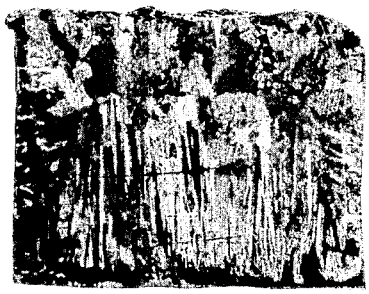
FIGS. 7*a* and 7*b* are photographs of macro-strucures of the inventive alloys prepared by adding V to Ti-containing alloys followed by casting in a shell mold (FIG. 7*a*) and in an exothermic mold (FIG. 7*b*)
Figure 7B:
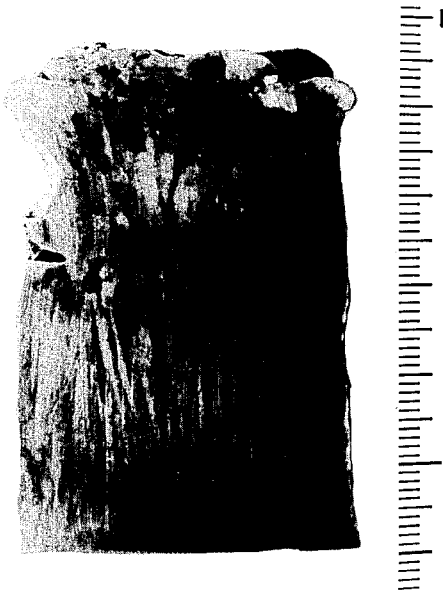

Two alloys I and II, one having a composition of, by weight ratio, 22% Cr—17% Co—3% Mo—0.1% Ti—0.3% V—the balance being essentially Fe and the other having the same composition with only a difference that the vanadium content is 2.0%, were melted in the atmosphere with the aid of a high-frequence furnace otherwise in the same manner as in Example 1. The melts were cast in a mold having a chill plate set on its bottom, said mold being adapted to yield castings of $40^{\phi} \times 35$ mm size. Subsequent suction of the melt into a silica tube gave samples of $5^{\phi} \times 10$ mm size. The macrostructure of which is illustrated in FIGS. 6*a* and 6*b* to show the alloys containing 0.3% and 2.0% of vanadium, respectively. Both alloys have a significant columnar structure well grown normal to the chill plate. A marked effect is found on the growth of columnar structure in either value of the vanadium content. Samples of the free structure and columnar structure thus prepared were subjected to heat treatments similar to those of Example 1. For the magnetic characteristics of the obtained magnet bodies, refer to Table 4.

TABLE 4

| Magnetic Characteristics | Free Structure I | Free Structure II | Columnar Structure I | Columnar Structure II |
|---|---|---|---|---|
| Br (KG) | 12.3 | 12.7 | 13.2 | 13.5 |
| Hc (Oe) | 680 | 765 | 810 | 865 |
| $(BH)_{max}$(MGOe) | 4.8 | 5.4 | 7.05 | 7.45 |

In Table 4, I and II denote the samples containing 0.3% and 2.0% of vanadium, respectively. As the titanium content decreases, the properties of the free structure become low since the denitrification effect of titanium deteriorates at a low content. However, increase in the vanadium content leads to improvements in the magnetic characteristics of the free structure and its corresponding columnar structure. It follows that vanadium is not only effective in the growth of the columnar structure, but has also the same requisite effect as what titanium has.

EXAMPLE 3

An alloy having the composition of, by weight ratio, 26% Cr—13% Co—4% Mo—0.24% Ti—3.0% V—the balance being essentially Fe was melted in the atmosphere with a high-frequence furnace. Part of the melt was cast in a shell mold provided with a chill plate similar to that used in Example 1 or 2, and sucked into a silica tube to prepare a sample of $5^{\phi} \times 10$ mm size. Another part of the melt was cast in an exothermic mold having a chill plate set on its bottom as in Example 1. The macro-structure of the obtained castings is illustrated in FIGS. *7a* and *7b* in which FIG. *7a* shows the alloy cast in the shell mold, and FIG. *7b* the alloy cast in the exothermic mold. It is found that, where the same exothermic material is used, the incorporation of vanadium makes contributions to the easy and satisfactory growth of the columnar structure. Samples of the columnar and free structure cut out of these alloys were subjected to heat treatment in a way equivalent to that of Example 1. For the resultant magnetic characteristics, refer to Table 5.

TABLE 5

| Magnetic Characteristics | Free Structure | Columnar Structure |
|---|---|---|
| Br (KG) | 12.5 | 13.8 |
| Hc (Oe) | 750 | 895 |
| $(BH)_{max}$(MGOe) | 5.2 | 8.8 |

EXAMPLE 4

Figure 8:
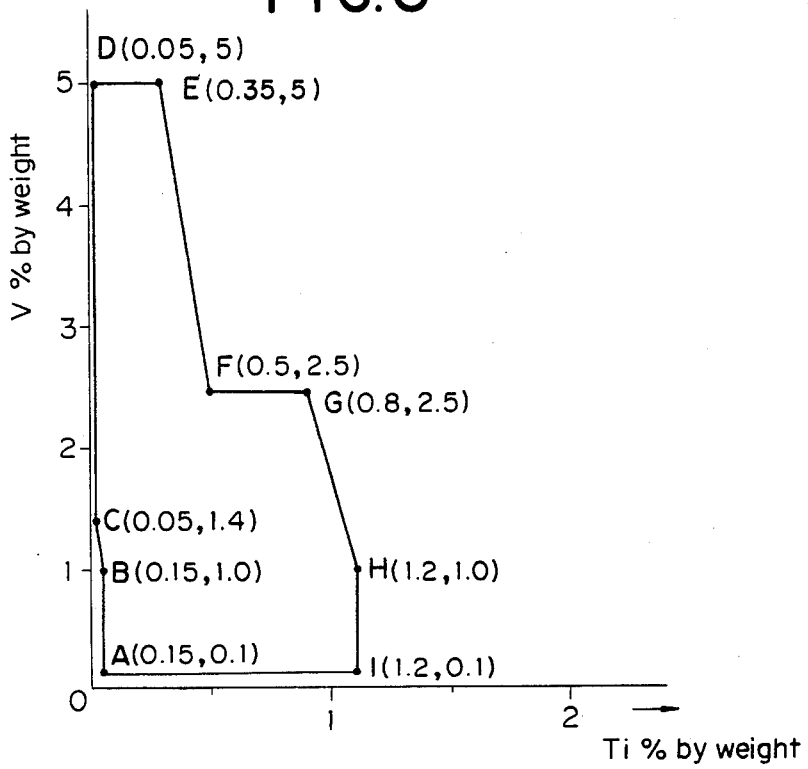
FIG. 8 is a graphic diagram showing the relationship between the amount of Ti-V added and the magnetic characteristics of the inventive magnet bodies.

In a manner as mentioned in Example 1, various magnet bodies were fabricated from a base alloy composition consisting of, by weight ratio, 24% Cr, 15% Co and 2% Mo and V and Ti with the balance being Fe, V and Ti being in amounts varying from 0 to 5%, respectively. The values of $(BH)_{max}$ as measured are plotted in the graphic diagram of FIG. 8.

The magnet bodies having the V-Ti composition range encircled with a closed line obtained by connecting points A to I and A inclusive exhibits a $(BH)_{max}$ value ranging from 7 up to 8.8. In the Ti-V coordinate system, points A to I inclusive are: A (0.15, 0.1), B (0.15, 1.0), C (0.05, 1.4), D (0.05, 5), E (0.35, 5), F (0.5, 2.5), G (0.8, 2.5), H (1.2, 1.0) and I (1.2, 0.1).

What is claimed is:

1. An Fe-Cr-Co type magnet body consisting essentially of columnar structure having a maximum energy product $(BH)_{max}$ of 7 MGOe or higher consisting essentially of by weight ratio, 5–30% cobalt, 15–40% chromium, 0.1–10% molybdenum, 0.05–1.2% titanium and 0.1–5% vanadium, with the balance being iron and inevitable impurities, said body having been subjected to columnar crystallization treatment.

2. The magnet body as recited in claim 1, which has a composition range of vanadium-titanium encircled by a closed line obtained by connecting points A to I and A inclusive in FIG. 8.

3. The magnet body as recited in claim 2, which has a maximum energy product of 8 MGOe or higher.

4. The magnet body as recited in claim 2, in which the base composition, except titanium and vanadium, consists essentially of, by weight ratio, 22–26% chromium, 13–17% cobalt and 1–5% molybdenum, with the balance being iron and inevitable impurities.

5. The magnetic body as recited in claim 4, in which the base composition includes 2–3% by weight molybdenum.

6. The magnet body as recited in claim 4, in which the base composition further includes, by weight ratio, 0.1–0.6% titanium and 0.2–4% vanadium.

7. The magnet body as recited in claim 5, in which the base composition includes, by weight ratio, 0.2–0.4% titanium and 0.3–3% vanadium.

* * * * *